US007549800B2

(12) United States Patent
Ajootian

(10) Patent No.: US 7,549,800 B2
(45) Date of Patent: Jun. 23, 2009

(54) COMBINATION COSMETIC PURSE AND DISPLAY PACKAGE

(76) Inventor: Janice K Ajootian, 128 Singleton St., Woonsocket, RI (US) 02895

( * ) Notice: Subject to any disclaimer, the term of this patent is extended or adjusted under 35 U.S.C. 154(b) by 336 days.

(21) Appl. No.: 11/635,751

(22) Filed: Dec. 7, 2006

(65) Prior Publication Data

US 2007/0092168 A1 Apr. 26, 2007

Related U.S. Application Data

(62) Division of application No. 10/735,239, filed on Dec. 12, 2003, now Pat. No. 7,147,374.

(60) Provisional application No. 60/436,183, filed on Dec. 26, 2002.

(51) Int. Cl.
*B65D 33/10* (2006.01)
*B65D 73/00* (2006.01)

(52) U.S. Cl. ..... 383/9; 206/466; 383/13; 383/64

(58) Field of Classification Search ..... 206/461, 206/466, 806; 383/5, 6, 9, 13, 22, 23, 61.2, 383/63, 64, 66

See application file for complete search history.

(56) References Cited

U.S. PATENT DOCUMENTS

| | | | | |
|---|---|---|---|---|
| 6,286,999 | B1 * | 9/2001 | Cappel et al. | 383/64 |
| 6,679,027 | B2 * | 1/2004 | Schreiter | 53/412 |
| 6,821,589 | B2 * | 11/2004 | Dobreski et al. | 383/64 |
| 2002/0076122 | A1 * | 6/2002 | Buchman | 383/64 |
| 2003/0179955 | A1 * | 9/2003 | Rehwinkel | 383/64 |
| 2003/0185468 | A1 * | 10/2003 | Keith et al. | 383/9 |
| 2004/0066985 | A1 * | 4/2004 | Patel et al. | 383/64 |
| 2004/0086206 | A1 * | 5/2004 | Tomic | 383/64 |

* cited by examiner

*Primary Examiner*—Luan K Bui
(74) *Attorney, Agent, or Firm*—Robert J Dohery

(57) ABSTRACT

A combination cosmetic purse and display package whereby an article to be displayed for purchase may be hung on a conventional point-of-purchase display rod and then that portion of the overall package provided for such purpose removed such that the remaining purse portion of the overall package may be used in a conventional manner such as a purse or carrier for cosmetics and personal items and wherein the travel of a slide closure is limited by a fused area of cooperating side panels which form the opening for the package.

6 Claims, 16 Drawing Sheets

COMBINATION COSMETIC PURSE AND DISPLAY PACKAGE

This application claims the benefit of Provisional Application Ser. No. 60/436,183 filed Dec. 26, 2002.

This application is a division of application Ser. No. 10/735,239 filed Dec. 12, 2003 and now U.S. Pat. No. 7,147,374 issued Dec. 12, 2006.

FIELD OF THE INVENTION

This invention relates to a cosmetic case or purse, which also may be utilized as a point-of-display sales package.

BACKGROUND OF THE INVENTION

Many cosmetic and beauty care items are sold in packages mounted from point-of-purchase display racks in which a forwardly projecting hook receives a plurality of such packages mounted thereon via an opening through a portion of the package itself. Generally, these packages take the form of a cardboard backing imprinted with advertising indicia or descriptive contents over which a clear bubble pack is formed displaying the contents therein. Once purchased, the packaging is torn away and discarded and the contents, e.g., cosmetics or personal care accessories, placed in the purchaser's purse or cosmetic case constructed especially for such purpose. Such items include lipsticks, makeup, nail care files and the like.

Obviously, other articles are sold in this manner and the present invention relates to a device in which not only the aforementioned cosmetics and personal care items can be sold and displayed but for practical purposes almost any type of article. Accordingly, the present invention is not limited to cosmetic and personal care items and the term "cosmetic case" in its broadest sense refers to a case or holding package that can be used for any relevant article or articles.

The cosmetic cases referred to in the present invention normally take the form of a cloth, plastic or leather-like container of a longitudinal overall shape and having an interior compartment or compartments primarily formed by sewing, sealing or otherwise attaching opposed side panels at their top edges and one side edge in a sealing relationship so that articles may be placed and held conveniently within the pouch-type interior provided by such configuration. Preferably, one of the longitudinal sides provides for an opening and which opening may be normally resealed by any convenient mechanism such as a slide fastener, zipper, snaps or springs. Normally the cosmetic case or purse is opaque, that is, not translucent or transparent, such that the case must be opened to view the contents in the interior pouch. On the other hand, the above referred to point-of-purchase and display packages are generally provided with a transparent or translucent front package face so that the contents therein can be easily viewed. Other than the aforementioned fact regarding visibility and that the packages are provided with a top opening through which they may be suspended from the forwardly projecting hook, the display packages may take almost any size, shape or configuration and are generally discarded after the contents thereof have been purchased and removed for use.

It would be immeasurably convenient, however, if an aesthetically acceptable point-of-purchase display package could be additionally used as a cosmetic case or purse which could accommodate not only the item or items purchased by the consumer but other convenient items as well that may be purchased at a later time or prior thereto. Accordingly, the primary object of the present invention is to provide a point-of-display sales package, which additionally serves as a cosmetic case or purse.

These and other objects of the present invention are accomplished by the provision of a generally elongated sales display package having opposed generally flexible side panels positioned in face-to-face relationship to each other and including sealed top and side edges to form a interior space between the panels accessible by an opening provided by an unsealed side edge preferably along one of the longitudinal edges thereof. It should be pointed out that normal configuration of such a combination cosmetic purse and display package would be rectangular having opposed upper and lower edges connected by a side edge wherein the opposite side edge has a pair of side panel edges serving to form the opening into the pouch or interior portion of the purse. In addition thereto, one of the upper edges is provided with an extension through which an opening to receive the display hook is formed. Such extension is formed in such a manner that it may be easily removed from the upper edge of the combined purse and display package such that the final configuration would not indicate the original previous use as a display package when utilized as a purse after the purchase of such item.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
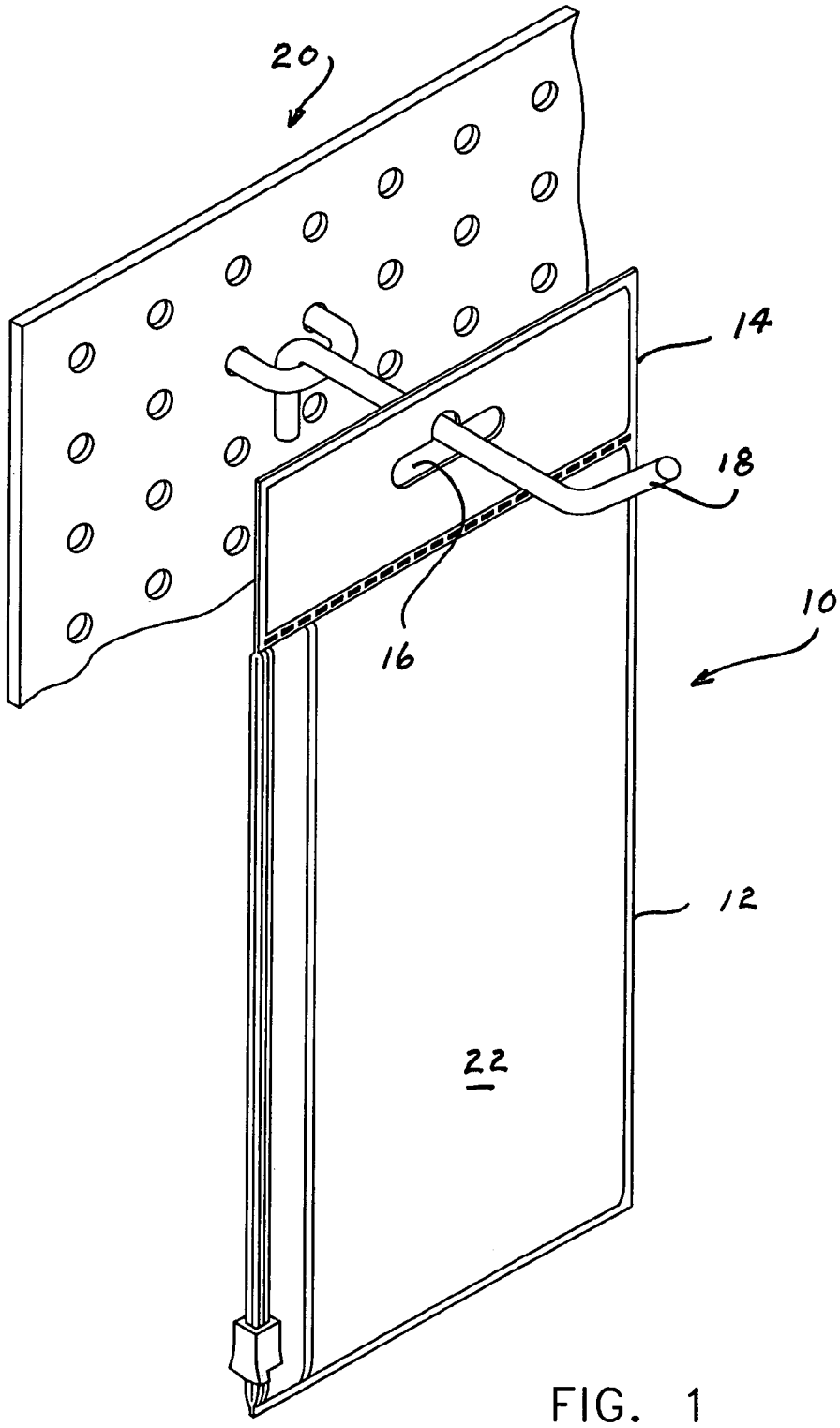
FIG. 1 shows the combined package and purse of the present invention displayed from a hook in turn mounted to a pegboard assembly.
Figure 2:
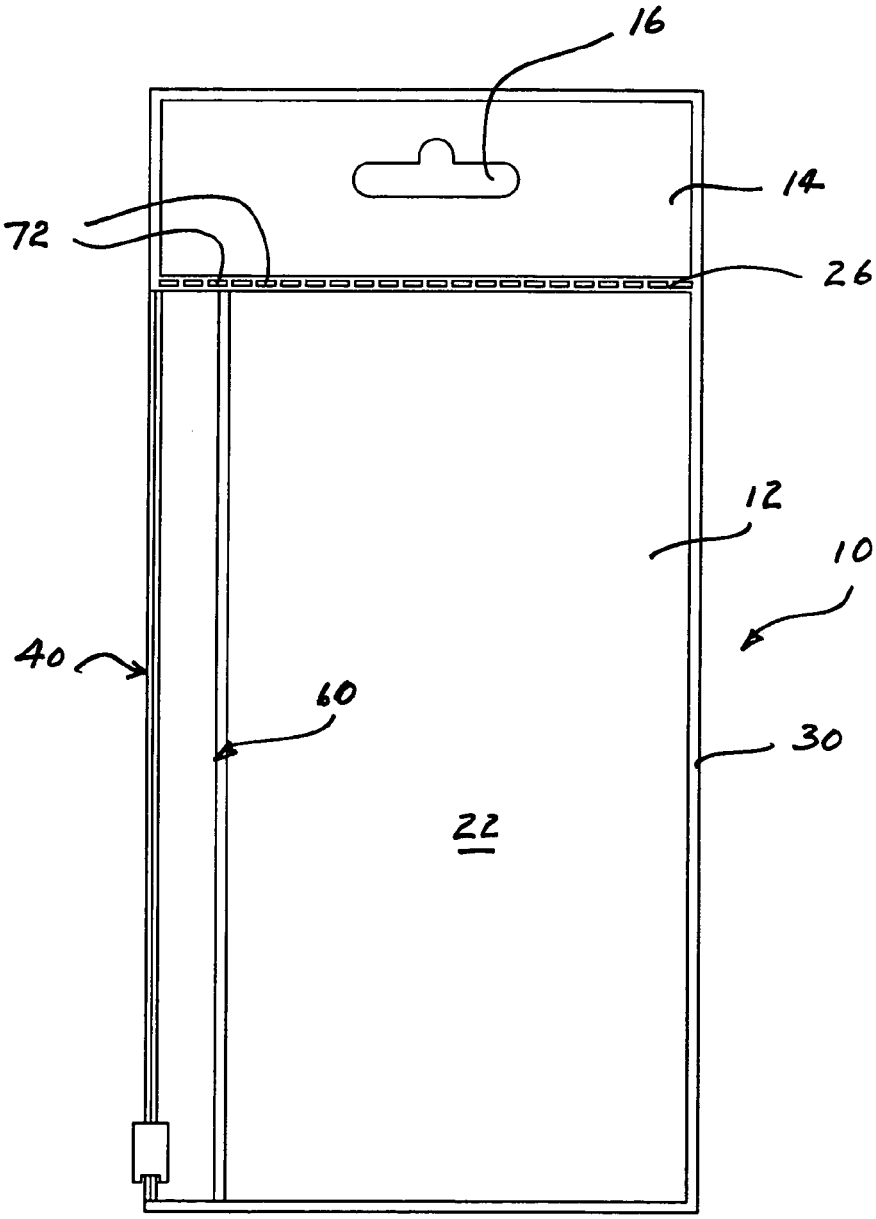
FIG. 2 is a front elevational view of the embodiment shown in FIG. 1.
Figure 7:
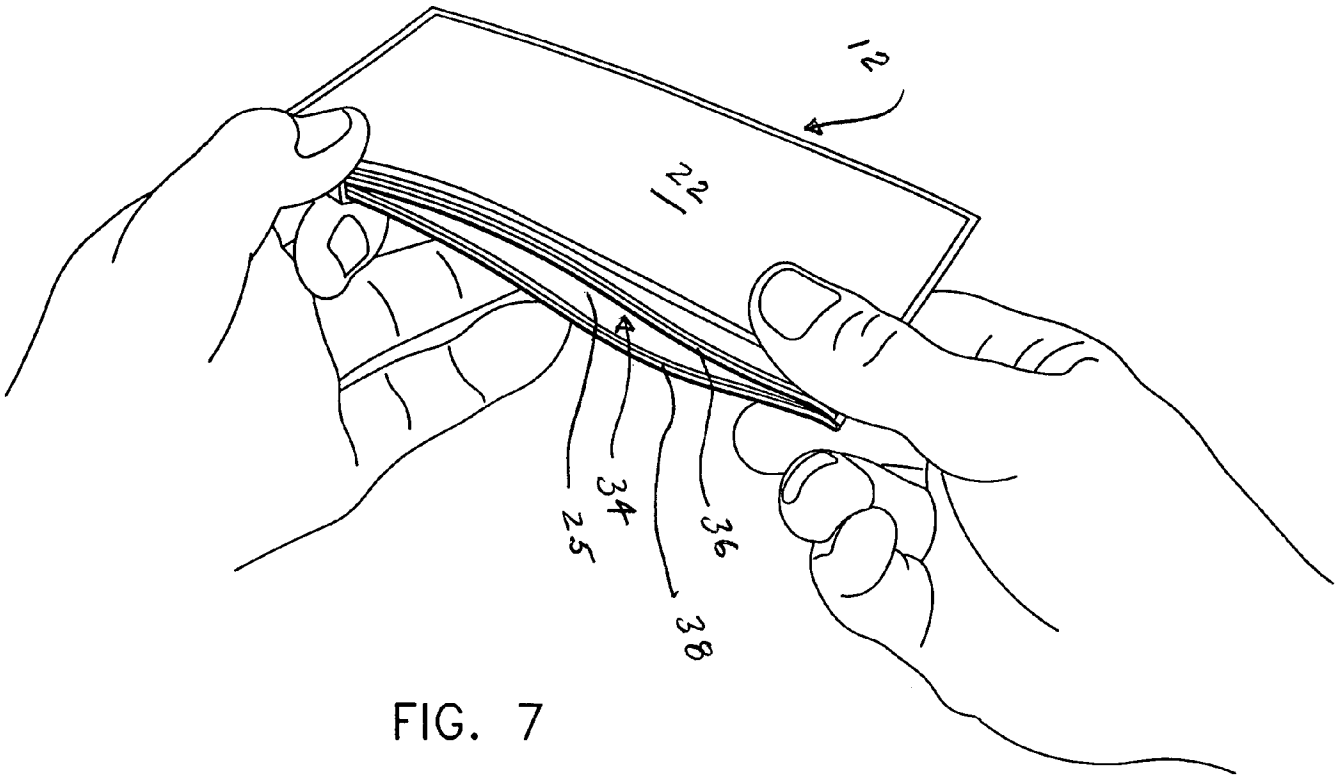
FIG. 7 is a perspective view showing how the purse assembly or container may be closed by operation of a slide fastener to sealingly engage the two opposed edges thereof.
Figure 8:
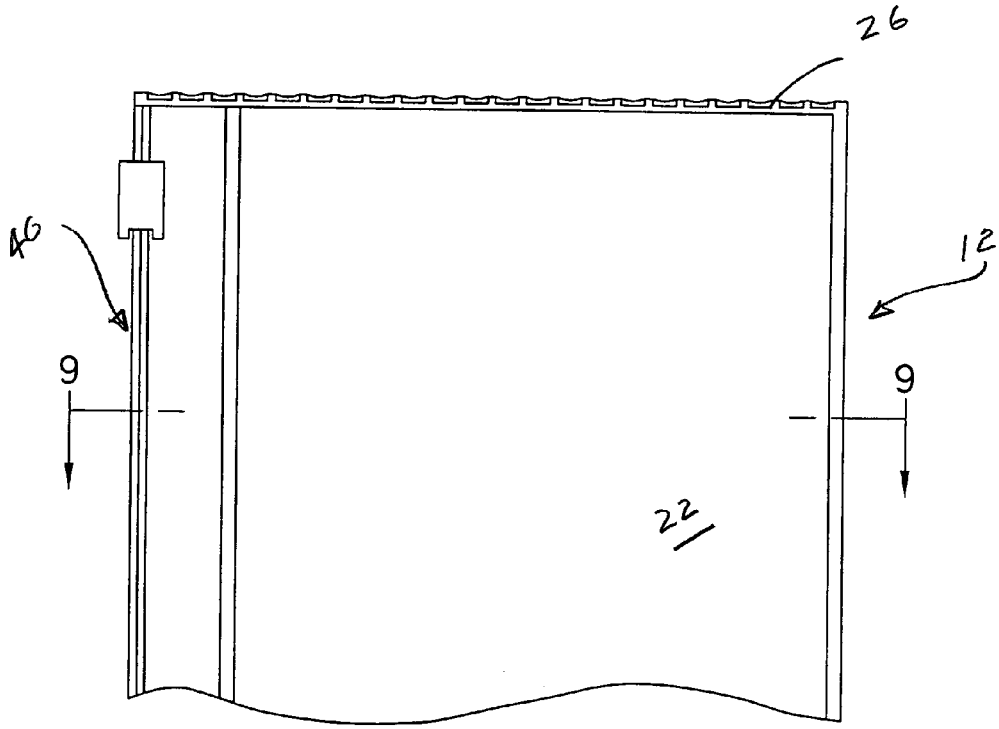
FIG. 8 is a front sectional view of a portion of the closed cosmetic purse.
Figure 9:
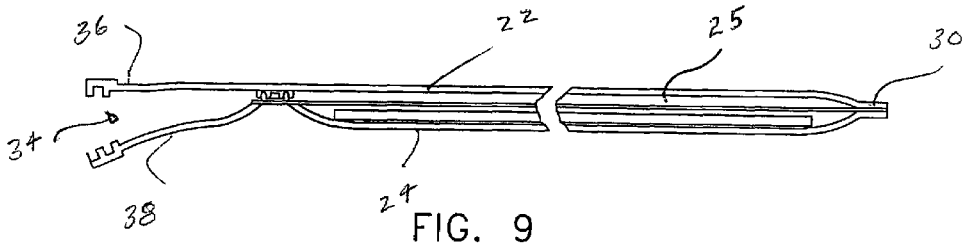
FIG. 9 is a top view taken along the line 9-9 or FIG. 8.
Figure 10:
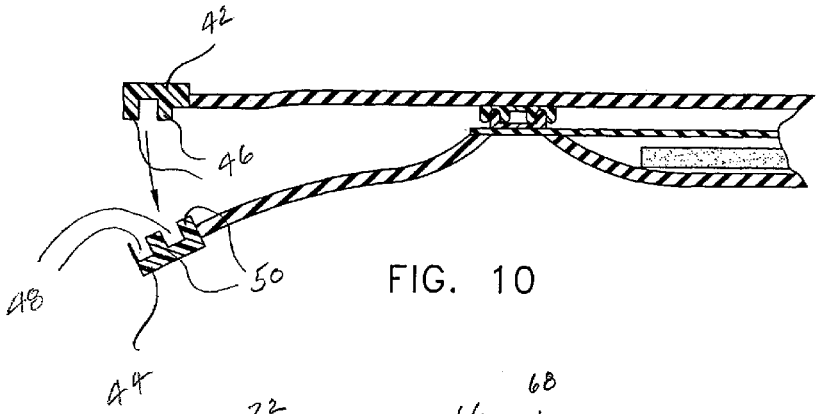
FIG. 10 is an enlarged view of a portion of FIG. 9 showing the internal or secondary seal that may be provided for the purse in a closed position.
Figure 11:
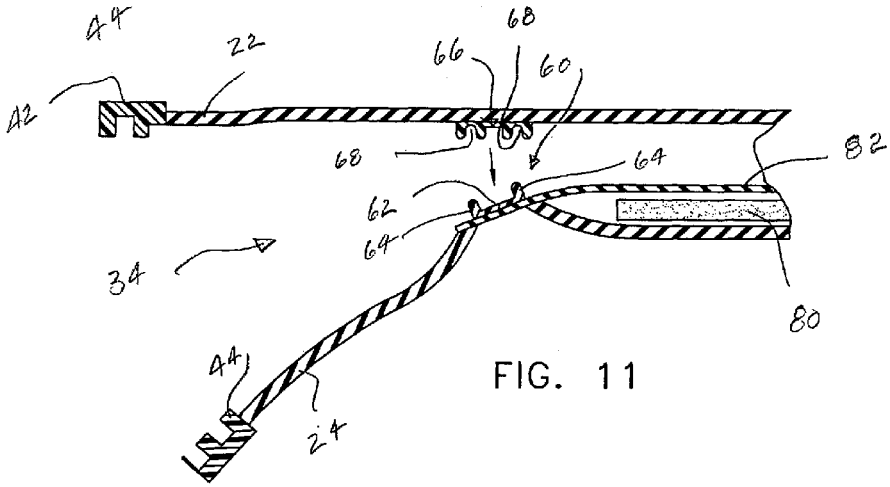
FIG. 11 is a view similar to FIG. 10 but showing the secondary seal in an open position.
Figure 12:
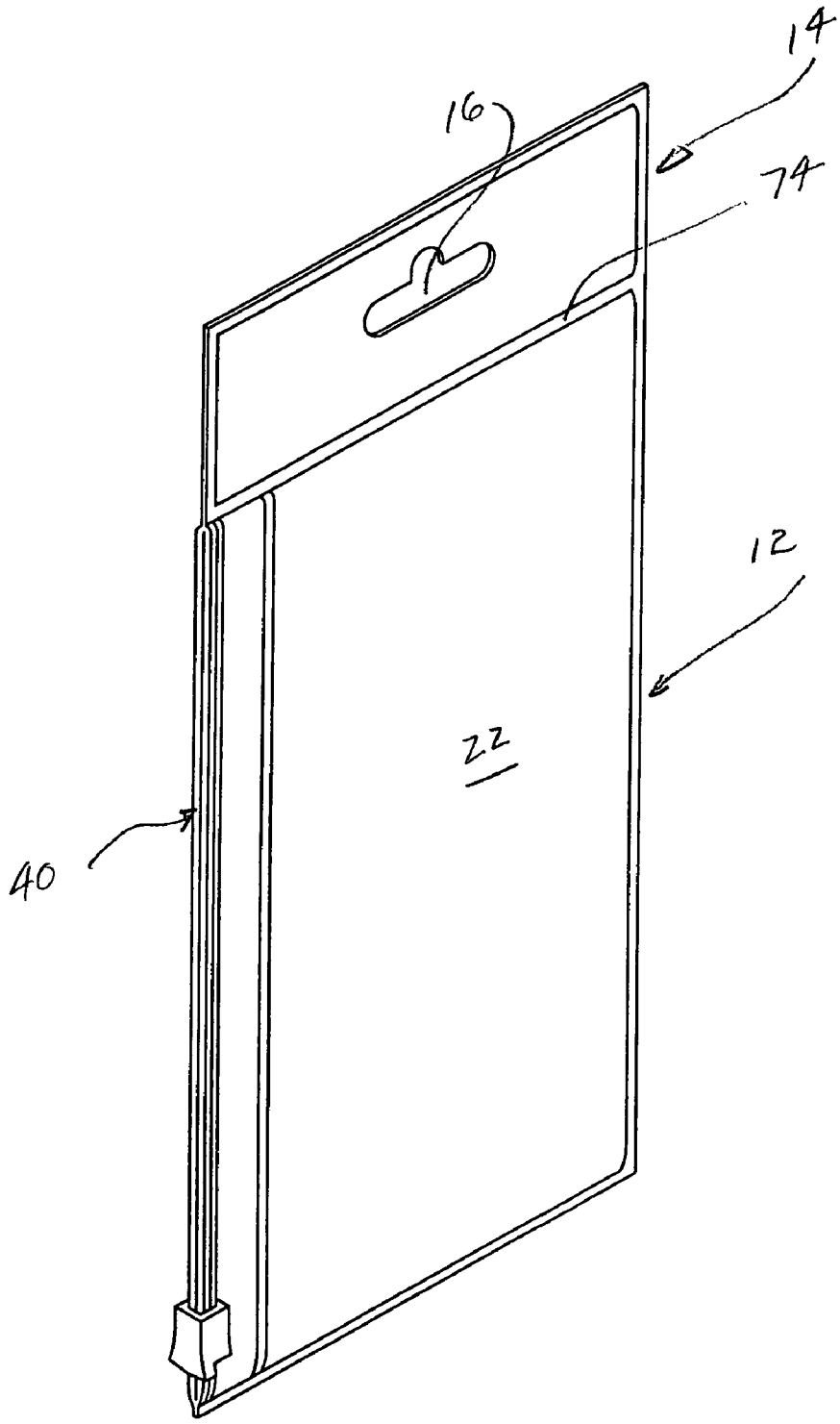
FIG. 12 is a front perspective view similar to FIG. 1 but showing a modified form of the invention wherein the body extension is removably detachable from the main portion of the purse via a sealed panel that is removed by cutting as illustrated in FIG. 13.

Turning now to the drawings and particularly FIGS. 1 and 7 thereof, the combination cosmetic purse and display package 10 is depicted. Such includes a purse portion 12 from which an extension panel 14 extends that in turn is provided with an opening 16 particularly adapted to receive the forwardly extending rod 18 of a display rod system 20. The purse or cosmetic case portion 12 includes front and rear sidewalls or panels 22 and 24 respectively which are disposed in superposed position with respect to each other and connected generally by heat fusion to each other at their peripheral top and bottom edges 26 and 28 and one side edge 30—the right such side edge 30 being depicted in FIG. 1 of the drawings.

The panels 22, 24 are preferably composed of flat sheets of a plastic resin such as polyvinyl chloride that is somewhat soft and pliable yet imparts transparent characteristics such that the contents therein may be easily viewed when desired. The opposite longitudinal side edge 32 (the left side edge in FIG. 1) forms an opening 34 through which the contents of the articles both displayed and later carried for use in the interior pocket 25 of the package may be retrieved. Such opening 34 is, in effect, formed by the terminal portions 36 and 38 of the top and bottom sidewalls or panels 22, 24 respectively. Such terminal portions or edges 36, 38 may additionally be provided with a closure assembly 40 in essence formed by opposed longitudinally extending shaped beads 42 and 44 respectively running the length of the left hand side edge of the panels as viewed in FIG. 1.

Figure 6:
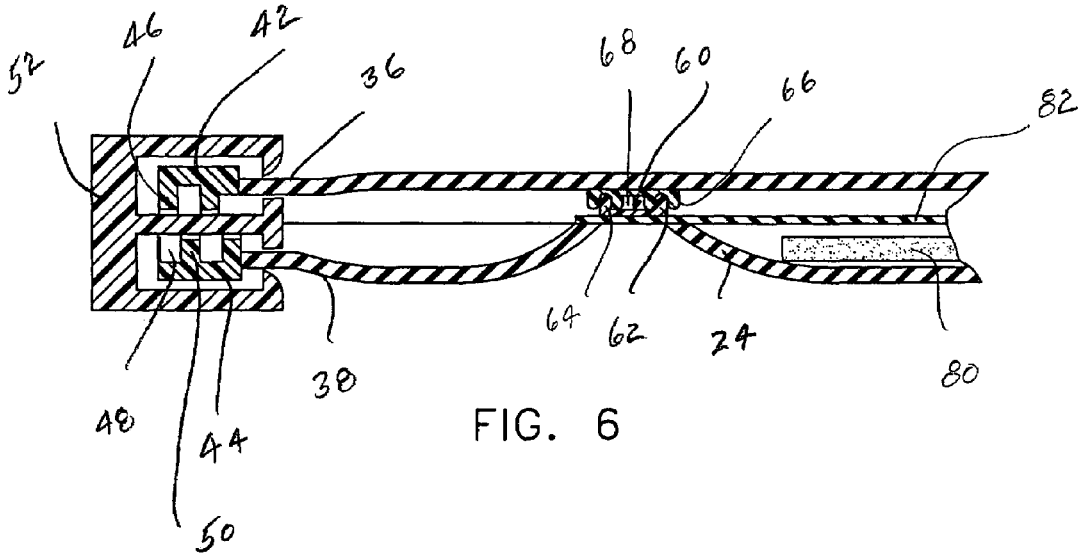
FIG. 6 is an enlarged partial sectional view of FIG. 5.

As best shown in FIG. 6, the running bead 42 on the top panel or sidewall 22 is provided with a pair of downwardly extending fingers 46 that are adapted to extend into the pockets 48 of a similarly shaped pair of fingers 50 formed on bead 44 but extending upwardly rather than downwardly as the case with the fingers 46. When these beads 42, 44 are pressed together, they interconnect thus forming the primary closure assembly 40. A slide fastener 52 is provided to incorporate convenience and form a positive mechanism by which the beads may be pushed together into a closed position or separated to form an open position. Obviously, other mechanisms may be provided to form the primary closure assembly 40 such as cooperating snaps longitudinally spaced along the side edges 36, 38 or even a conventional zipper system or cooperating Velcro hook and loop strips. The overall concept of a combination cosmetic purse and display package 10, however, is to present a generally low cost yet visually acceptable and operable product, and the sliding bead mechanisms 42, 44 meet such criteria. Also when cooperating beads are utilized to form the closure assembly, they may take other configurations than those described above.

In addition, a secondary closure system 60 may be provided, if desired, and such as best shown in FIG. 6 comprises a generally U-shaped bead 62 formed on bottom sidewall or panel 24 and having spaced fingers 64 adapted to be received within a somewhat similarly shaped bead 66 provided with laterally spaced U-shaped openings 68 formed on upper sidewall 22 and adapted to receive the fingers 64. By simply pressing these members or secondary beads 66 and 62 together, a secondary albeit less positive sealing effect is brought about between the sidewalls 22 and 24.

Figure 3:
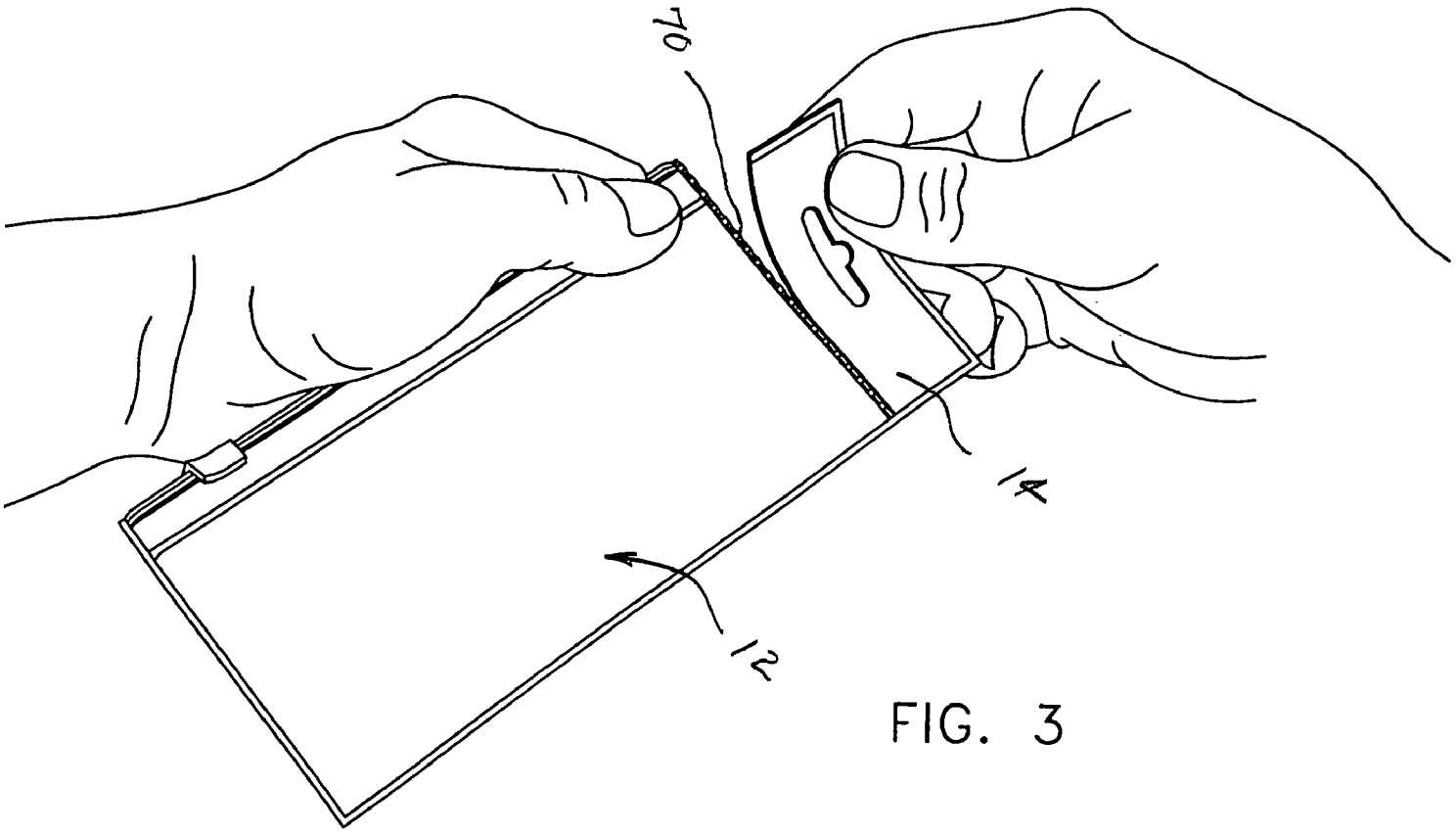
FIG. 3 is a perspective view showing the manner in which the body extension may be removed.
Figure 4:
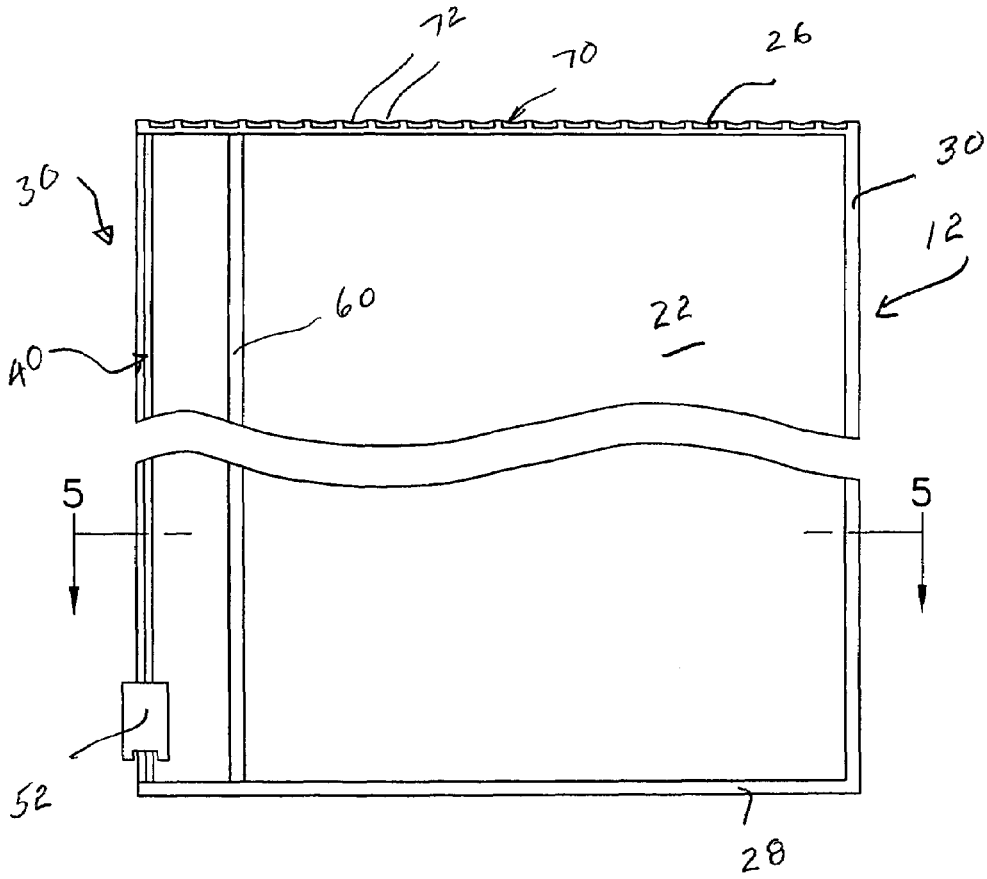
FIG. 4 is a front elevational view showing the combined package of FIG. 2 with the body extension removed.
Figure 5:
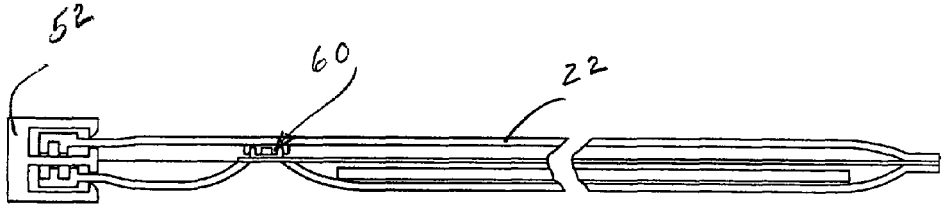
FIG. 5 is a top sectional view along the line 5-5 of FIG. 4.
Figure 13:
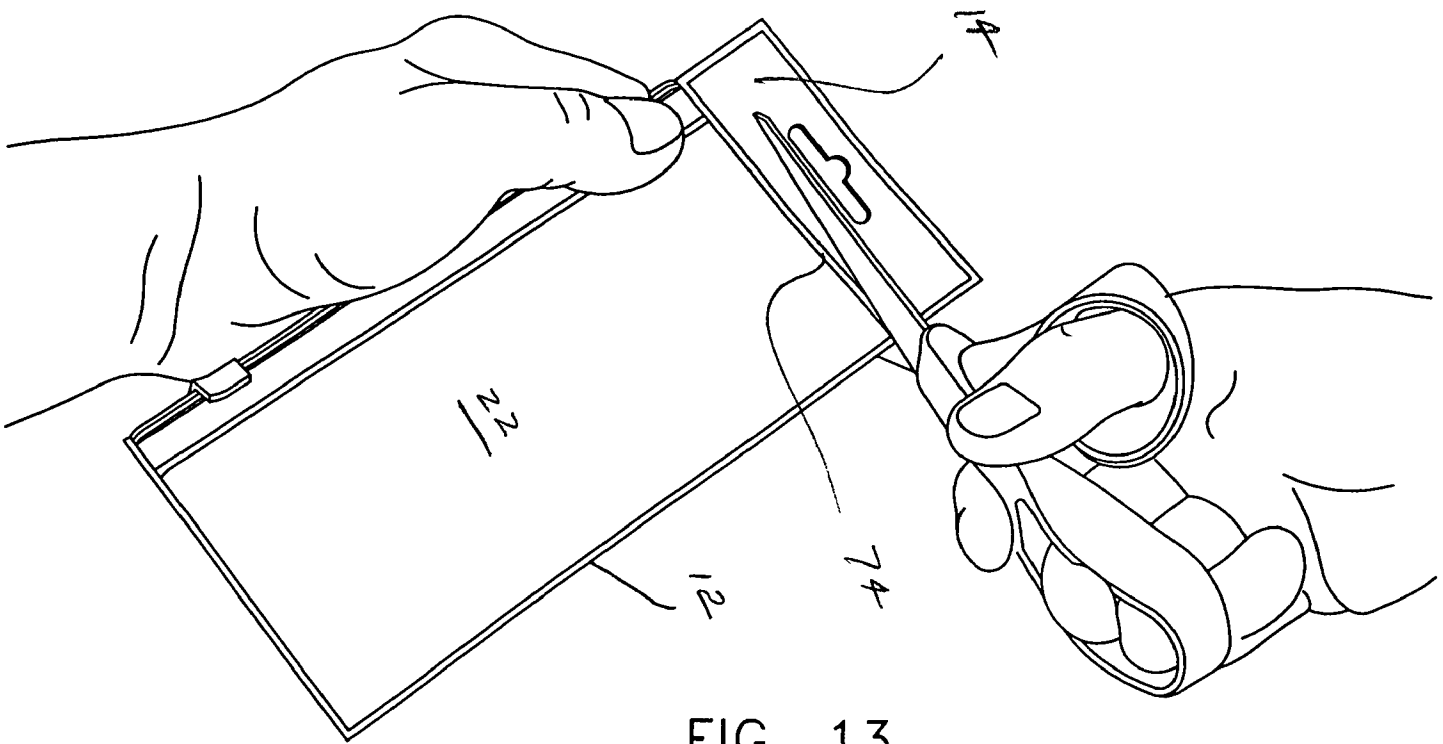
FIG. 13 is a view similar to FIG. 12 showing the removal process thereof.

In order to utilize the device 10 of the present invention in its initial roll as a sales display package, one or both of the panels 22, 24 is provided with an upwardly extending extension panel 14 which is connected to the upper edge 26 of the purse by a weakened line 70 which may comprise perforations 72. Such weakened line 70 should be disposed above the area that effects sealing between the sidewalls or panels 22, 24 at the upper edge 26 and should not interfere with such seal when the weakened line is, in effect, removed either by tearing as shown in FIG. 3 or by scissors as shown in FIG. 13 when the weakened line, in effect, is a material panel 74. Within the extension panel 14, an opening 74 of any desired configuration to accept the mounting hook 18 is provided. It should be pointed out that in some instances, it might be unnecessary or undesirable to remove the extension panel 14 from the purse 12—such decision being left entirely up to the purchasing consumer.

The package 10 may be decorated in various fashions as by imprinting either the front or back panels or sidewalls 22, 24 or both with a decorative design and in some cases can either be translucent or function as a visual barrier. It is, however, a desirable feature of the present invention that one of the panels or sidewalls 22, 24 be at least translucent and possibly transparent such that when that panel is displayed outermost when the package is being utilized as a display package will enable the merchandise contained therein to be easily viewed by the purchasing consumer. Also and as shown by the drawings, e.g., FIG. 6, in some cases it may be desirable to add a foam or other material pad 80 between the panels 22 and 24 by, in effect, either attaching such pad 80 to the inside surface of one of the panels or sandwiching such between the inside surface of one of the panels and a secondary or intermediate panel 82 provided for such purpose. The secondary or intermediate panel as well as the pad 80 may then be captured in place by the mechanism by which the terminal edges 36, 38 and 40 are sealed together—one such mechanism being a heat-sealing of the plastic sheets together. The purpose of the pad is to give some bulk and give some added flexibility to the purse mechanism to simulate a normal cloth-type purse of a more expensive nature. The pad 80 may also supply decoration as when the panels or sidewalls 22, 24 are transparent.

Figure 14:
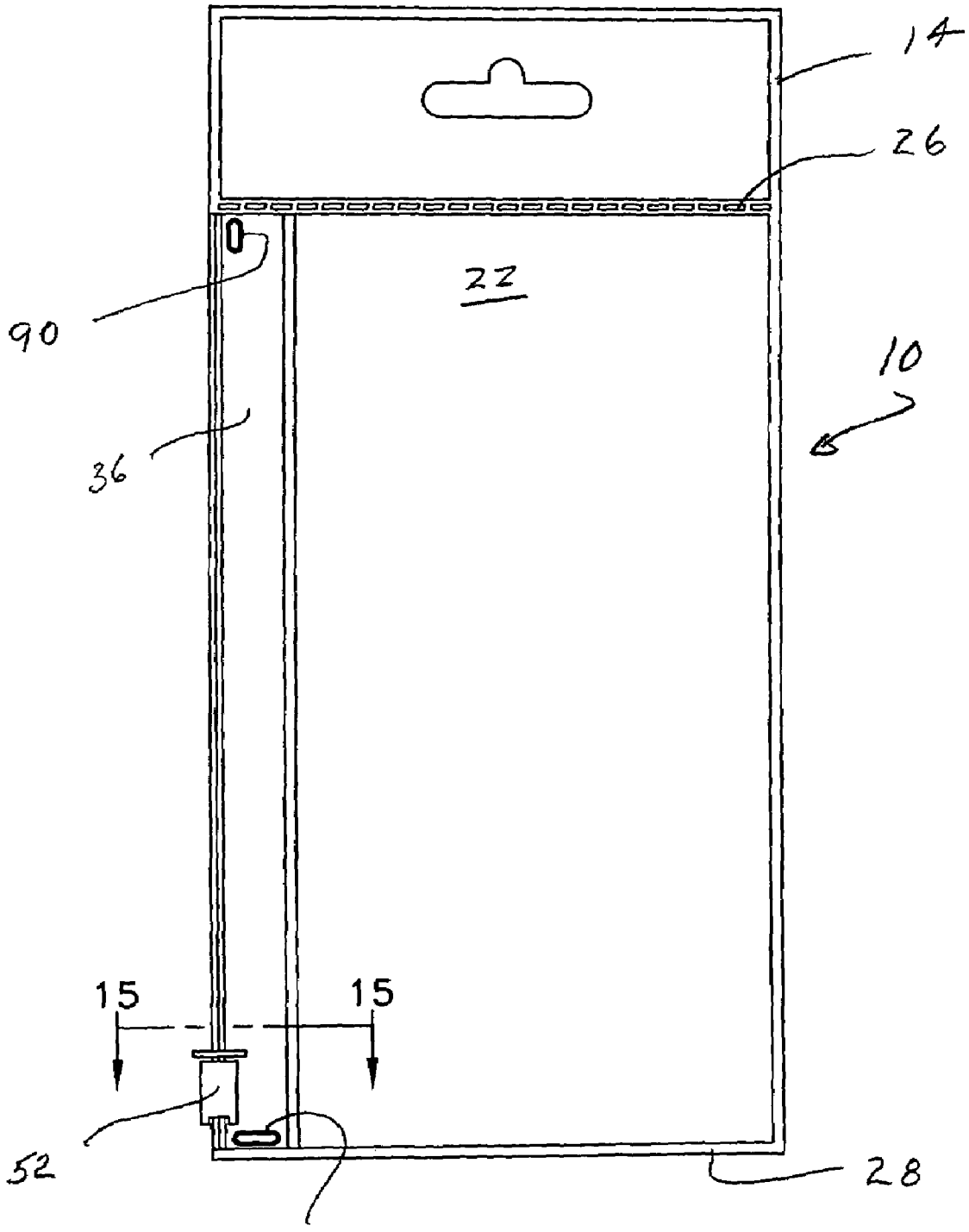
FIG. 14 is a front elevational view of another embodiment of the invention in which a lock is provided such that the openable side edge cannot be easily tampered with prior to purchase of the package.
Figure 15:
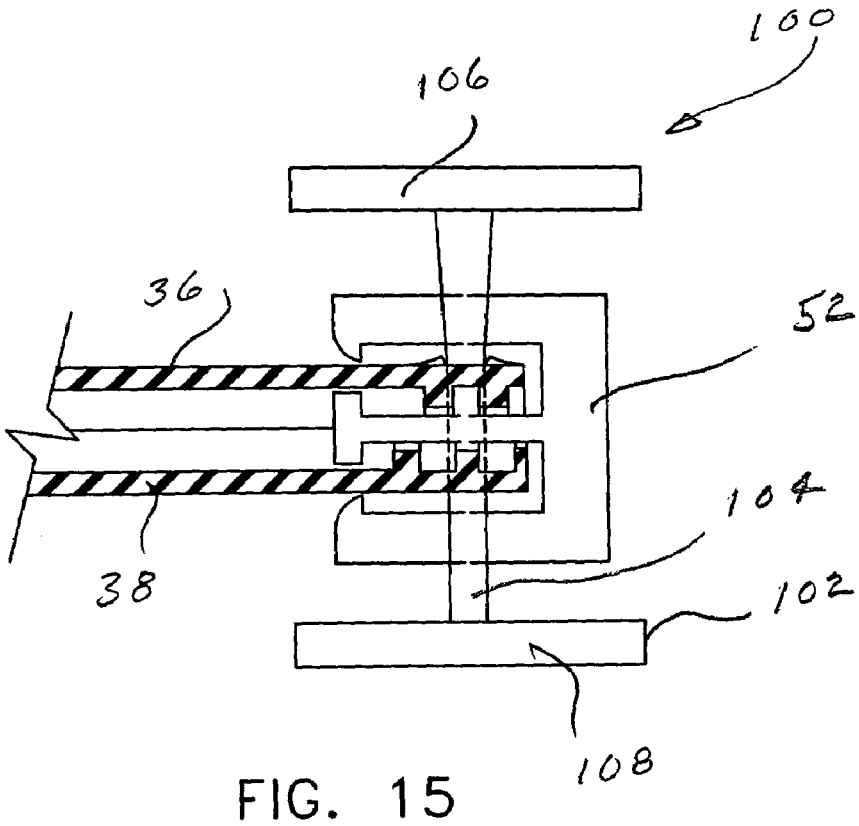
FIG. 15 is a sectional view along the line 15-15 of FIG. 14.
Figure 16:
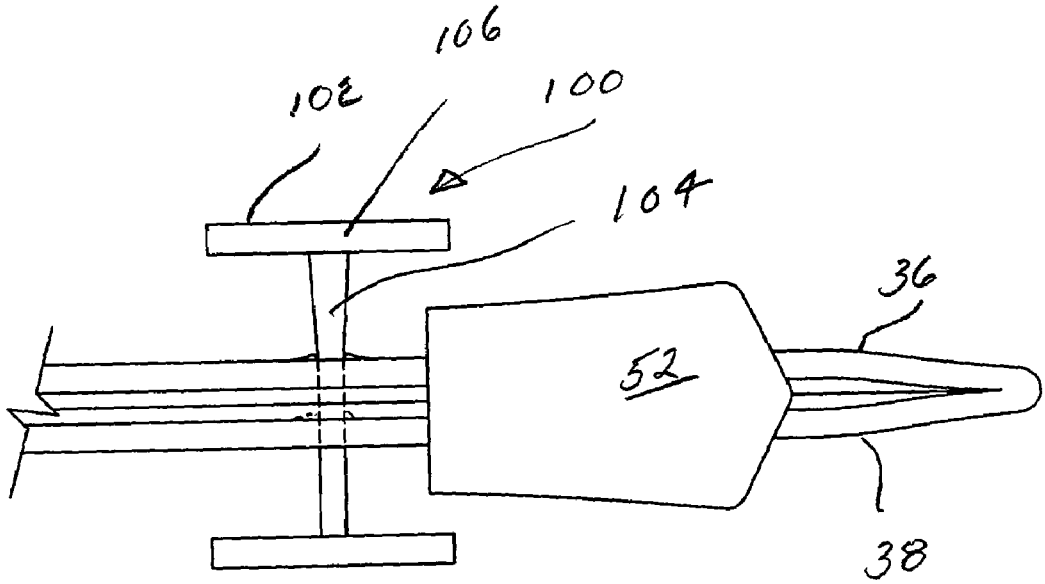
FIG. 16 is a partial elevational view viewed from line 16-16 of FIG. 14.

Turning now to FIG. 14, several additional features of the present combination purse and display package will be evident. Inasmuch as the slide 52 in use is repeatedly moved back and forth along the terminal portions 36, 38 of the top and bottom panels to open and close the opening 34 as desired, some care is advisable considering that the materials forming the various package components are generally pliable plastic sheet material such that excess force on the slide 52 or other areas will not over time eventually cause rupture or partial separation of panel portions 22, 24 which form the fused edges 26, 28 which in turn partly serve to form the interior pocket 25 in which the articles to be transported/displayed are housed. Accordingly, areas of the panel portions 36, 38 adjacent the upper fused edge 26 and the lower edge 28 and the opening 40 are, in effect, spot fused together to form upper and lower tear stops 90, 92 respectively.

Figure 20:
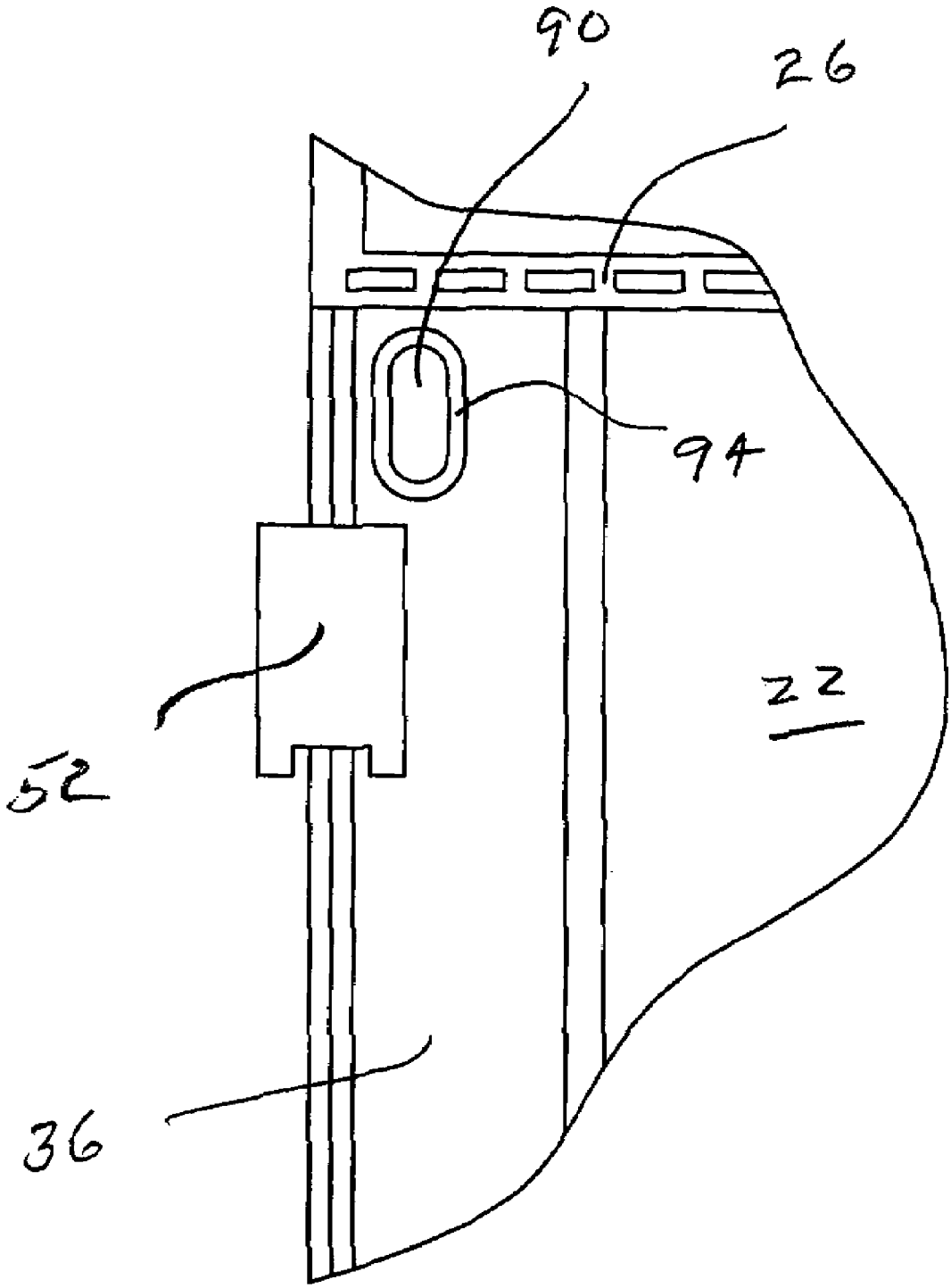
FIG. 20 is a front elevational view that illustrates still another embodiment of the invention.
Figure 21:
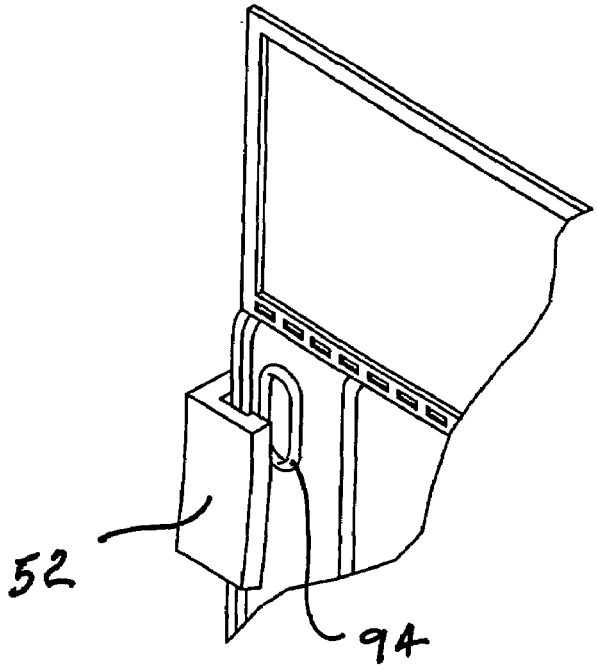
FIG. 21 is an enlarged partial view of FIG. 20.
Figure 22:
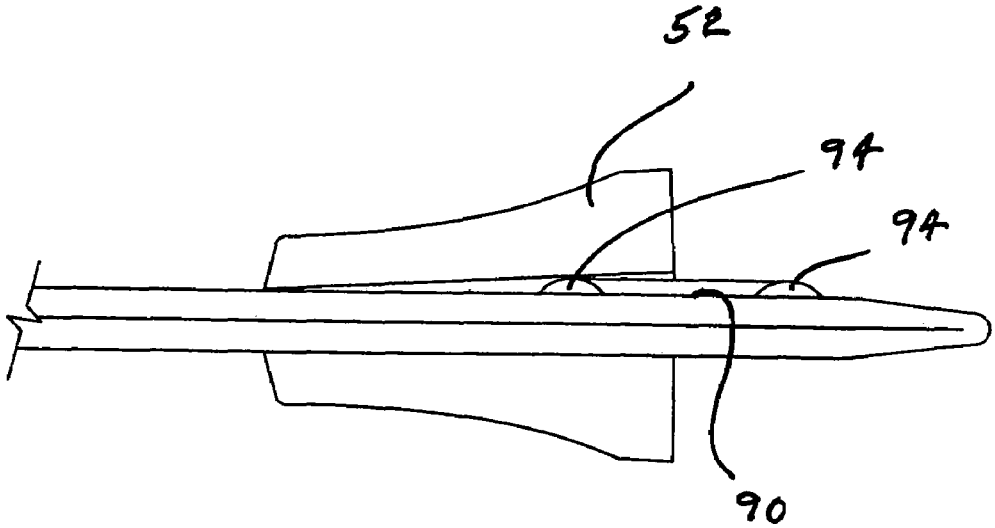
FIG. 22 is a side view of FIG. 21.

As with most slides, the slide 52 is directional, that is, the slide opens or separates the edges 36, 38 as it moves upwardly (towards the top of the drawing in FIG. 20) and closes, that is, urges, the edges 36, 38 together when moved in the opposite direction. In order to prevent the slide from over contacting upper edge 26, the upper tear stop 90 is located in the path of the slide 52 and such slide preferably contacts tear stop 90 by riding up slightly over the upstanding peripheral ridge 94 thereof. The ridge 94 is formed when the panels 22, 24 are fused together at that location by the action of a heated die.

Thus when fully opening the package, the user can sense, that is, feel, a frictional resistance to the slide when it contacts the tear stop 90 and utilize that input to forgo further slide movement. Similarly, the lower tear strip is located adjacent the lower edge 38 and the lower portion of the opening 40.

It is desirable to keep the package 10 locked while displayed for purchase so that the merchandise housed therein and readily viewable due to the see thru characteristics of the package cannot be easily removed prior to purchase. To accomplish such, a unique locking system 100 has been provided. Such system includes a locking member 102 that prevents the slide from any substantial longitudinal movement and thus prevents the edges 36, 38 from being opened. The locking member may comprise an intermediate slender pin-shaped member or shaft 104 having integral T-shaped heads 106, 108 at opposite terminal ends thereof.

Figure 17A:
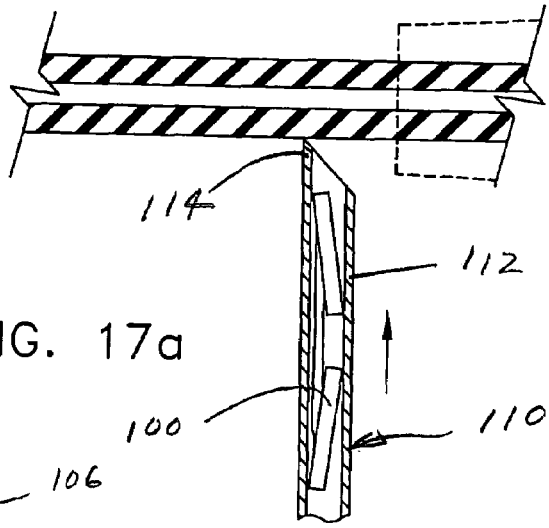
FIG. 17*a* is a view similar to FIG. 16 but showing an initial step in inserting the locking member in place.
Figure 17B:
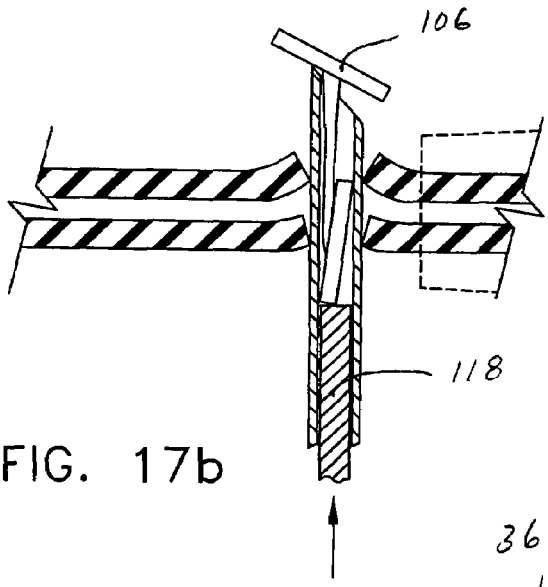
FIG. 17*b* is a view similar to FIG. 16 but showing an intermediate step in the insertion of the locking member.
Figure 17C:
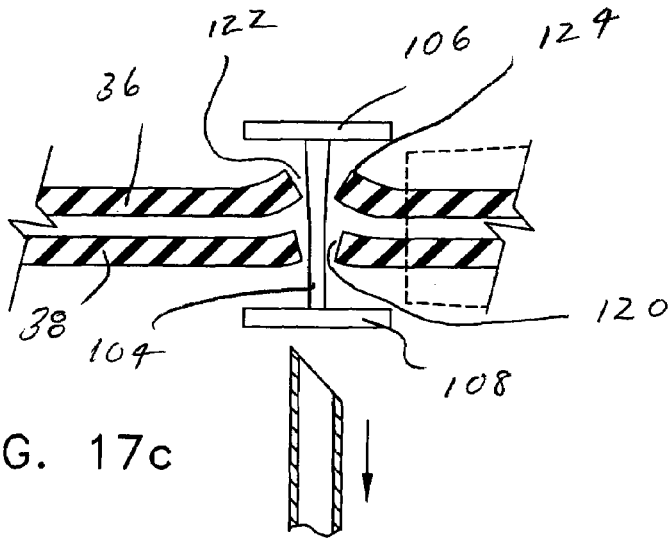
FIG. 17*c* is a view similar to FIG. 16 but showing the locking member fully positioned.
Figure 18:
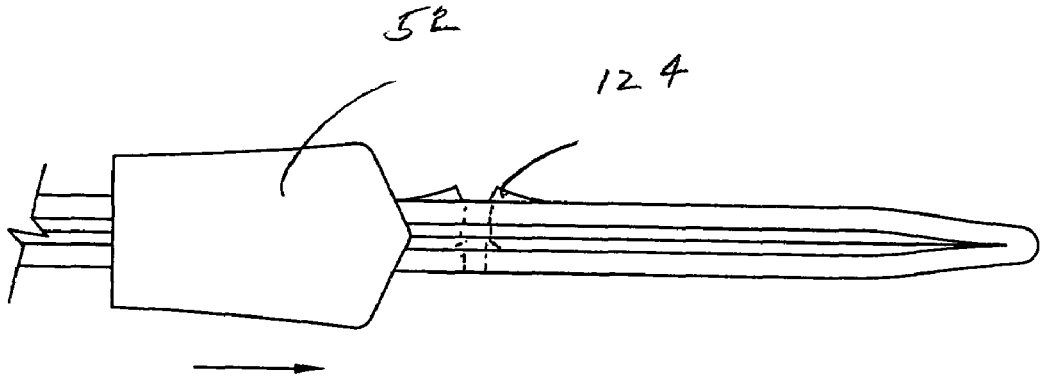
FIG. 18 is a partial top view of the openable side edge in an open position and being closed by a slide member.
Figure 19:
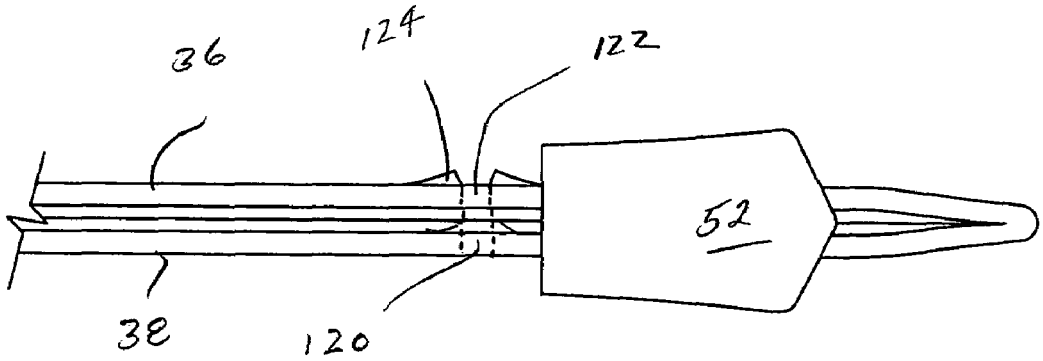
FIG. 19 is a view similar to FIG. 18 but showing the openable side edge closed with the slide member positioned adjacent to the combination tactile lock position sensor and stop.

The shaft extends through both edges 36, 38 at a point adjacent the inner or proximal face 52*a* of the slide and is preferably positioned thereat by a puncturing tool 110 having a hollow tube 112 with a sharpened end 114 in which the locking member is positioned in a flattened disposition. Thereafter, the edges 36, 38 are pierced as shown in FIG. 17*b* and a plunger (not shown) mounted to slide within the tube 112 is utilized to force the upper head 106 beyond the upper extent of the tube end 114 so that the head 106 by reason of elastic memory reassumes a T-shaped orientation with respect to the shaft 104. Thereafter, the tube 112 is withdrawn, thus capturing and positioning the locking member to the edges 36, 38 by means of the holes 116, 118 formed therethrough by the puncturing/positioning tool. As the tool moves through the plastic sheets that form edges 36, 38, the tool forms holes 120, 122 therethrough and forms an upstanding crater or ridge 124 as the tool passes through edge 36 at the upper or outer surface thereof.

Similar structures and puncturing tools are utilized to attach buttons to clothing in lieu of sewing. In addition, other tools with a moderately sharpened end could be used to penetrate the panel edges 36, 38 and to form the upset material ridge 124 that serves as the secondary or tactile lock.

This somewhat circular reverse crater thus presents surface portions slightly above the upper surface of edge 36 and forms a secondary or sensory stop over which the slide 52 must pass after the shaft 104 of the locking member is cut by any suitable means such as scissors, nail clipper, etc. and then the locking member fully removed from the edges 36, 38. In other words, by positioning the locking member adjacent the slide when the slide is in the position where the edges 36, 38 are closed together prevents the slide from being opened for unauthorized access to the package interior as when on display at the store. Once purchased and the locking member removed, then the slide can freely move to its open position.

In moving to such open position, the slide does encounter some slight resistance as it contacts the crater 124 which resistance can be felt by the person operating the slide. The crater thus acts as a positioning device or partial stop to keep the slide closed from accidental opening and as a sensing means that provides a tactile feedback to the operator such that she/he recognizes when the stop is being overcome by the slide in the opening procedure. Similarly when the operator is moving the slide to the closed position, the opposite is true, that is, the slide passing over the crater warns the operator that the end of the possible slide travel is approaching and or completed and further closure force is unnecessary.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A combination purse and display package comprising a purse portion including top and bottom sheet material panels wherein at least one of said panels is at least partially transparent, said panels disposed in superposed position and permanently interconnected to each other at their top and bottom edges and at one longitudinal side edge so as to define a storage and display space therebetween for receipt of items therein, the opposite longitudinal side edge from said one longitudinal side edge including opposed terminal edge portions of said top and bottom panels which in turn are not permanently interconnected to each other and separated from each other in an open position so as to form a longitudinal opening therebetween such that items may be inserted and removed from said space and closure means associated with said opposite longitudinal side edges for temporarily sealing such opposite side edges together to close said purse portion in a closed position thereof, said closure means including a slide member operatively receiving said closure means so as to press the closure means together when the slide is moved from the open to the closed position and vice versa, said slide member movable along a longitudinal path beginning at a completed closed position adjacent the bottom edge of said panels to a completely open position adjacent the top edge of said panels and a first tear stop comprising a fused area of said panels positioned adjacent said top edge and within said longitudinal path, said package further including an extension panel upwardly extending from said interconnected top edge of said panels and in turn provided with an opening therethrough whereby said combination purse and display package can be suspended from a hook adapted to extend normally through said opening such that said package is displayed for sale, said extension panel separable from said purse portion adjacent said interconnected top edge without disturbing the permanent interconnection of such top edge.

2. The combination purse and display package of claim 1, said first tear stop including a ridge upstanding from the surface of one of said panels, said slide contacting said ridge proximal to the end its travel to the completely open position.

3. The combination purse and display package of claim 1, said extension panel separable from said purse portion along a weakened line formed entirely within said extension panel adjacent said interconnected top edge.

4. The combination purse and display package of claim 1, said extension panel separable from said purse portion along a non-weakened cut line disposed entirely within said extension panel.

5. The combination purse and display package of claim 1, said extension panel being a continuation of at least one of said top and bottom panels.

6. The combination purse and display package of claim 1, said slide member having a proximal face inwardly disposed to the longitudinal extent of the cooperating closure edges, a locking system positioned adjacent said slide member proximal face so as to prevent opening slide movement when the slide member is in the fully closed position, said locking system including aligned openings through said edges and a locking member positioned within said openings and extending beyond said edges on either sides thereof.

* * * * *